US009365065B2

(12) United States Patent
Zheng et al.

(10) Patent No.: US 9,365,065 B2
(45) Date of Patent: Jun. 14, 2016

(54) PRINTING PROCESS AND PRINTING AUXILIARY AGENT USED THEREIN

(75) Inventors: Xudong Zheng, Shanghai (CN); Shanzhong Chen, Shanghai (CN)

(73) Assignee: SHANGHAI EAST STAR ENVIRONMENTAL INKS CO., LTD., Nanxiang Town, Jiading District, Shanghai (CN)

( * ) Notice: Subject to any disclaimer, the term of this patent is extended or adjusted under 35 U.S.C. 154(b) by 661 days.

(21) Appl. No.: 13/577,574

(22) PCT Filed: Jan. 12, 2011

(86) PCT No.: PCT/CN2011/070191

§ 371 (c)(1),
(2), (4) Date: Aug. 7, 2012

(87) PCT Pub. No.: WO2011/110059

PCT Pub. Date: Sep. 15, 2011

(65) Prior Publication Data

US 2013/0003130 A1 Jan. 3, 2013

(30) Foreign Application Priority Data

Mar. 12, 2010 (CN) ..... 2010 1 0124658

(51) Int. Cl.
*B41M 5/00* (2006.01)
*B05D 3/10* (2006.01)
(Continued)

(52) U.S. Cl.
CPC ..... *B41M 5/0011* (2013.01); *B41M 1/26* (2013.01); *B05D 3/10* (2013.01); *B41M 1/305* (2013.01); *B41M 5/0017* (2013.01)

(58) Field of Classification Search
CPC ..... B41M 5/0011; B41M 5/0017; B05D 3/10
USPC ..... 427/301, 323; 347/100
See application file for complete search history.

(56) References Cited

U.S. PATENT DOCUMENTS 6,833,008 B2 * 12/2004 Nitzan et al. ..... 8/508
8,236,385 B2 * 8/2012 Yahiaoui et al. ..... 427/412
(Continued)

FOREIGN PATENT DOCUMENTS

CN 1764754 A 4/2006
CN 101160214 A 4/2008
(Continued)

OTHER PUBLICATIONS

International Search Report for PCT/CN2011/070191, dated Apr. 21, 2011.

*Primary Examiner* — Cachet Sellman
(74) *Attorney, Agent, or Firm* — Global IP Services; Tianhua Gu

(57) ABSTRACT

A printing process and a printing auxiliary agent used therein are disclosed. The printing process comprises mounting a plate, applying ink, conveying an object to be printed, and impressing. The printing auxiliary agent is applied to the object to be printed before an impressing point in an optional printing station. The printing auxiliary agent includes water and/or an organic substance which is in liquid state under normal temperature and normal pressure. The use of the printing auxiliary agent is also disclosed. The printing process and the printing auxiliary agent can be used in printing of all kinds of objects to be printed, thus improving printing quality.

11 Claims, 2 Drawing Sheets

(51) Int. Cl.
*B41M 1/26* (2006.01)
*B41M 1/30* (2006.01)

(56) References Cited

U.S. PATENT DOCUMENTS

2002/0192381 A1* 12/2002 Nitzan et al. ..... 427/322
2005/0243121 A1* 11/2005 Onishi ..... 347/21
2007/0011819 A1* 1/2007 DeVries et al. ..... 8/115.51
2007/0040879 A1* 2/2007 Chung et al. ..... 347/96

FOREIGN PATENT DOCUMENTS

EP 1577101 A2 9/2005
JP 2004-330569 A 11/2004

* cited by examiner

PRINTING PROCESS AND PRINTING AUXILIARY AGENT USED THEREIN

FIELD OF THE INVENTION

The present invention relates to printing industry field, and more particularly to a printing process and printing auxiliary agent used therein

BACKGROUND

Significant development has been made in printing technology since its origin as one of the Four Great Inventions in ancient China.

The present printing process generally includes the following steps: 1. substrate transport and printing preparation for single-color or multi-color printing process; 2. first color (or background color) printing: transfer the printing ink of a first printing station to the substrate by printing plate (or screen); 3. drying by forced or natural evaporation to remove water and organic solvents from the printing ink by heating, ventilation and so on; 4. second color printing: transferring the printing ink in a second printing station to the suitable positions of the substrate by printing plate (or printing screen) followed by drying; 5. performing other printing processes.

With regard to the current printing technology, poor surface flatness of substrates (e.g., paper, fabrics, nonwoven paper and plastic thin film) would directly influence the printing quality. As for substrates with rough surface, such as kraft paper, fabrics and nonwoven paper, the surface is generally not in complete contact with the printing plate, resulting undesirable consequences such as discontinuous and white leak after printing, significantly affecting printing precision and hindering further progress.

Generally, the problems mentioned above are solved by improving papermaking process to increase paper flatness. However, such measures increase manufacturing cost, yet not completely resolving the problems of printing quality.

The printing of nonwoven fabric material, a high-end product in architectural decoration industry, also encounter the same problems because such materials have irregular surface with fiber structure designed to catch people's eyes as elegant works of art. And yet it is exactly the surface irregularity that results in poor contact between the concave portion on the surface and the printing roller during substrate inking and therefore causes small breaks or large areas of white points in the printed portion, especially for patterns with dark background, greatly deteriorating the printing effect as a whole.

SUMMARY OF THE INVENTION

An object of the present invention is to overcome the defects of the prior art by providing a printing process and printing auxiliary agent used therein so as to solve the technical problems of the prior art, namely breaks, white leak or missing coating.

In order to solve the foregoing technical problems, the present invention adopts the following printing process.

The present invention disclosed a printing process including steps of mounting a plate, applying ink, conveying an object to be printed, and impressing. The printing auxiliary agent is applied on the substrate to be imprinted (i.e., the substrate waiting to be imprinted at the selected printing station) before the print impression points of any selected printing station. The printing auxiliary agent includes water and/or organic compounds that are liquid under normal conditions.

The process of plate mounting, inking, substrate transport and imprinting are performed by conventional procedures.

The term "printing station" refers to a unit on the printing press that has functions such as substrate transport, inking, imprinting and drying, and includes components such as printing plate, impression roller, inking device, drying device and transmission device. A printing press usually comprises one or more printing stations.

The term "print impression points" are the place at a printing station where the printing plate and impression roller contact with the substrate.

The printing auxiliary agent could be applied separately on the substrate, which means that the printing auxiliary agent is applied independently on the substrate, a way different from conventional method by which the printing auxiliary agent is required to be mixed as an auxiliary material into the printing ink to be applied on the substrate.

The process of applying the printing auxiliary agent on the substrate to be imprinted separately before the print impression points of any selected printing station, refers to any one of the following situations: for a printing process involving only one printing station, applying the printing auxiliary agent separately on part or whole of the substrate to be imprinted before the substrate to be imprinted reaches the print impression points of the printing station; or for a printing process involving multiple printing stations and one or more printing stations being selected, for each printing station selected, applying the printing auxiliary agent separately on part or whole of the part of the substrate that has not been imprinted at this specific printing station before the substrate that is not imprinted at said printing station reaches the print impression points of said printing station.

The method of independently applying a printing auxiliary agent on a substrate can be selected from printing, coating, spraying or immersion.

After being applied with a printing auxiliary agent, the substrate should be kept moist so as to have it imprinted at the selected printing station before the printing auxiliary agent applied being completely dried.

After being independently applied with a printing auxiliary agent, the impression procedure should be conducted with the total amount of the water and organic compounds which is liquid under normal conditions contained in the substrate being ranging from 0.5~105 g/m$^2$ (that is, 0.5~105 g per square meter of the substrate), preferably 2.5~30 g/m$^2$ on substrate. This total amount of the water and organic compounds which is liquid under normal conditions contained in each square meter of the substrate refers as the "total retention amount". For the substrates made of different materials, the preferable total retention amount may change on a slight basis. Such as, for nonwoven substrate, a preferable total retention amount is 1~96 g/m$^2$ on substrate; as for textile substrate, a preferable total retention amount is 5~105 g/m$^2$ on substrate; as for paper substrate, a preferable total retention amount is 1~20 g/m$^2$ on substrate; as for plastic substrate, a preferable total retention amount is 0.5~15 g/m$^2$ on substrate; as for rubber substrate, a preferable total retention amount is 0.5~20 g/m$^2$ on substrate; as for ceramic substrate, a preferable total retention amount is 5~50 g/m$^2$ on substrate. The control of the total retention amount can be realized by the application amount of printing auxiliary agent or by proper drying after application.

During the printing process of the present invention, the step of the printing, coating, spraying, or immersion of the printing auxiliary agent is arranged before the print impression points of the first printing station, and can be adjusted according to the printing pattern features and the sequence of each kind of single-color printing. The process can work effectively to the most extent when it is conducted before the step of imprinting at the printing station where missing printing or missing coating is most likely to occur. Moreover, the steps of printing, coating, spraying or immersion of the printing auxiliary agent is not limited to only once and, if necessary, further application may be made completely or partially at appropriate positions according to actual requirements.

Upon the completion of imprinting at all printing stations, various conventional steps, such as drying, solidification, trimming, slitting and packaging, can be performed subsequently.

In the present invention, the substrates can be various kinds of conventional substrates, including but not limited to nonwoven substrate, textile substrate, paper substrate, plastic substrate, rubber substrate, ceramic substrate and so on, such as kraft paper, newsprint paper, book paper, decorating paper, dowling paper, coated paper, wrapping paper, poster paper, deckle-edged paper, banknote paper, fiber fabrics, nonwoven fabrics, building board, floor tile and wall tile. The printing process of the present invention is particularly suitable for the foregoing substrates with uneven surface.

The printing process of the present invention can be applied to many printing fields, such as but not limited to, relief printing, gravure printing, permeographic printing (screen or rotary screen) and flexographic printing.

The key point for the printing process of the present invention lies in that a crucial printing auxiliary agent which can greatly enhance the printing ink transfer ratio is used before the step of imprinting at printing station.

The printing ink can be various kinds of conventional printing ink. The term of "printing ink" is a general concept of, for example but not limited to, solvent ink, water-based ink, ultraviolet (UV) ink and other liquid inks, and can be colored or colorless.

The printing auxiliary agent should meet the following features: Able to moisten the surface (layer) of substrate. Having appropriate volatility to enable proper drying condition as substrate is formally printed, therefore ensuring the improvement effect on printing. Having appropriate surface tension to support the printing ink and transfer the ink to the concave portion of substrate in time, therefore fulfilling the purpose of improving the printing quality.

The present invention provides a printing auxiliary agent meeting the features above, wherein said printing auxiliary agent comprises one or more of water and organic compounds that are liquid under normal conditions.

Said printing auxiliary agent could be, for example but not limited to, in forms of solution, suspension or emulsion.

Said printing auxiliary agent comprising water and/or organic compounds that are liquid under normal conditions means that, the printing auxiliary agent comprises water or organic compounds that are liquid under normal conditions, or the printing auxiliary agent comprises water and organic compounds that are liquid under normal conditions. For example, the printing auxiliary agent can be water, or only one kind of organic compound that is liquid under normal conditions, or more kinds of organic compounds that are liquid under normal conditions, and, of course, also can be water and one or more kinds of organic compounds that are liquid under normal conditions in combination simultaneously. Water and/or organic compounds that are liquid under normal conditions can be mixed in any ratio.

The sum of the weight percents of said water and organic compounds that are liquid under normal conditions is 50%-100%, preferably 70%-100%, and more preferably 80%-100%.

Preferably, the printing auxiliary agent is a homogeneous liquid.

The organic compounds that are liquid under normal conditions are organic solvents that are liquid under normal conditions. Organic solvents that are liquid under normal conditions are one or more selected from aromatic hydrocarbon, aliphatic hydrocarbon, alicyclic hydrocarbon, halide, alcohol, ether, ester, ketone, phenol and diol derivative that are liquid under normal conditions. For example, said organic solvents that are liquid under normal conditions can be one or more selected from methanol, ethanol, isopropanol, ethanediol, propanediol, diethylene glycol, dipropylene glycol, dipropylene glycol monomethyl ether, dipropylene glycol monoethyl ether, dipropylene glycol monopropyl ether, dipropylene glycol monobutyl ether, diethylene glycol monomethyl ether, diethylene glycol monoethyl ether, diethylene glycol monopropyl ether, diethylene glycol monobutyl ether, benzene, methylbenzene, dimethyl benzene, propanone, butanone, cyclohexanone, ethyl acetate, propyl acetate and butyl acetate. Each of the solvents listed above can be used individually with the printing quality of uneven substrate improved. The selected solvents could be mixed with each other and the mixture could also improve the printing quality of uneven substrate.

Said printing auxiliary agent can be further added with one or more of resin, cosolvent, surface active agent, antifoaming agent, screening agent and rheological agent according to requirements. Said printing auxiliary agent can comprise resin for printing ink use or not.

Preferably, said printing auxiliary agent is water, one kind of organic compound that is liquid under normal conditions, a homogeneous mixture of more kinds of organic compounds that are liquid under normal conditions, or a homogeneous mixture of water and one or more kinds of organic compounds that are liquid under normal conditions.

Printing auxiliary agents having water and/or organic compounds that are liquid under normal conditions can improve the printing quality of any kind of substrate with uneven surface. For optimal printing effect, the proportion of ingredients in printing auxiliary agent is not fixed and can be changed according to factors such as substrate properties, heating temperatures in printing machine, hot wind conditions, coating thickness, printing speed, and the space between coating and printing positions.

Printing auxiliary agents having multiple ingredients can be produced by uniformly mixing the selected ingredients according to the proportion.

The printing auxiliary agent and printing process in the present invention can be applied to the printing of various kinds of substrates, and is particularly suitable for the improvement of the printing quality of substrates. The inventor is surprised to find that the phenomenon of missing printing or missing coating can be effectively prevented or improved, without adjusting the original printing process sequence, simply by adding a step of independently applying a printing auxiliary agent with certain fluidity before the printing station where missing printing or missing coating occurs during pre-printing or before the printing station where missing printing or missing coating is expected to occur.

Said substrate is nonwoven substrate, fabric substrate, paper substrate, plastic substrate, rubber substrate, or ceramic substrate, such as kraft paper, newsprint paper, book paper, glazed paper, decorating paper, art paper, packing paper, poster paper, deckle-edged paper, banknote paper, fiber fabrics, nonwoven fabrics, building board, floor tile and wall tile.

Said printing auxiliary agent can improve the transfer of the printing ink on substrate and thus improving the problem of printing quality of substrate.

Improving the problem of printing quality of substrate refers to improving the quality problem of missing printing or missing coating occurring during the printing of substrate due to uneven surface.

Said printing auxiliary agent can be used before the print impression points of any selected printing station during the printing of various kinds of substrates.

Said printing auxiliary agent can be used in the following ways: before the print impression points of any selected printing station, a printing auxiliary agent alone is applied on substrate, wherein the application method can be selected from printing, coating, spraying or immersion.

Preferably, an additional step of independently applying a printing auxiliary agent on the substrate to be imprinted (i.e., substrate waiting to be imprinted at the selected printing station) before the print impression points of the printing station where missing printing or missing coating occurs during the original printing process.

After being applied with a layer of printing auxiliary agent, the substrate should be kept moist as much as possible so as to have it imprinted at the selected printing station without the printing auxiliary agent being completely dried.

After being independently applied with a printing auxiliary agent, the substrate is imprinted with the total retention amount of water and organic compounds that are liquid under normal conditions in printing auxiliary agent at 0.5-105 g/m$^2$ on substrate. As for substrates made of different material, the preferable total retention amount may change on a slight basis, wherein as for nonwoven substrate, a preferable total retention amount is 1-96 g/m$^2$ on substrate; as for fabric substrate, a preferable total retention amount is 5-105 g/m$^2$ on substrate; as for paper substrate, a preferable total retention amount is 1-20 g/m$^2$ on substrate; as for plastic substrate, a preferable total retention amount is 0.5-15 g/m$^2$ on substrate; as for rubber substrate, a preferable total retention amount is 0.5-20 g/m$^2$ on substrate; as for ceramic substrate, a preferable total retention amount is 5-50 g/m$^2$ on substrate. The total retention amount can be controlled by the application amount of printing auxiliary agent or by proper drying after application for those skilled in the art.

Said printing auxiliary agent can be applied by printing using the printing station or device existing on the printing press or additionally provided, or by coating, spraying or immersion manually or using the device existing on the printing press or additionally provided.

The method for printing said substrate can be selected from various kinds of printing methods such as relief printing, gravure printing, flexographic printing, or permeographic printing (screen or rotary screen printing).

In the printing process of the present invention, the use of printing auxiliary agent can greatly improve the printability of substrate and the transfer of printing ink on substrate. The printing auxiliary agent gives consideration to the physical and chemical properties of both printing ink and substrate, and the best modification effect can be obtained simply by choosing proper printing auxiliary agent according to the material and property of the printing ink and substrate being used, and by adjusting the amount of coating according to the site conditions during printing such as temperature and humidity conditions, heating and drying conditions, and printing speed

The left picture shows the printing effect without printing auxiliary agent, the right picture shows the printing effect with printing auxiliary agent.

Figure 2:
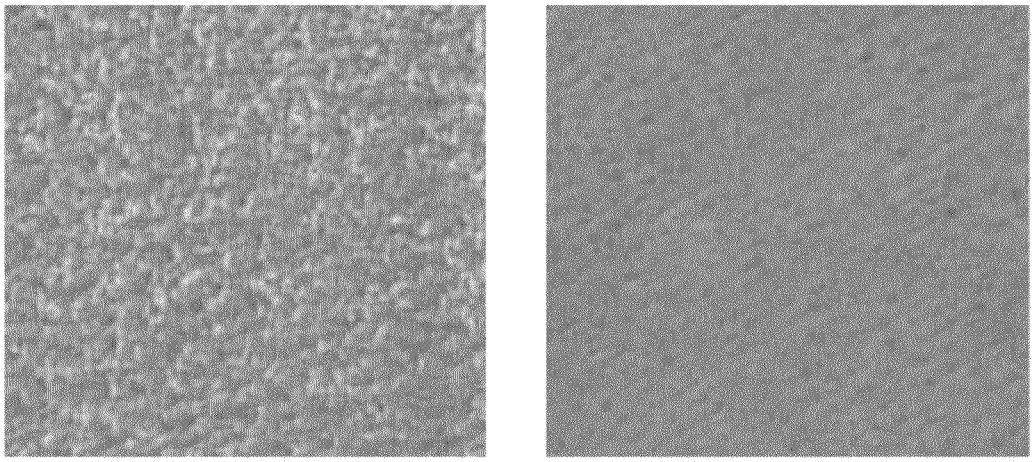

FIG. 2 is a 25-fold enlargement for comparison of the printing effects in embodiment 3.

The left picture shows the printing effect without printing auxiliary agent, the right picture shows the printing effect with printing auxiliary agent.

Figure 3:
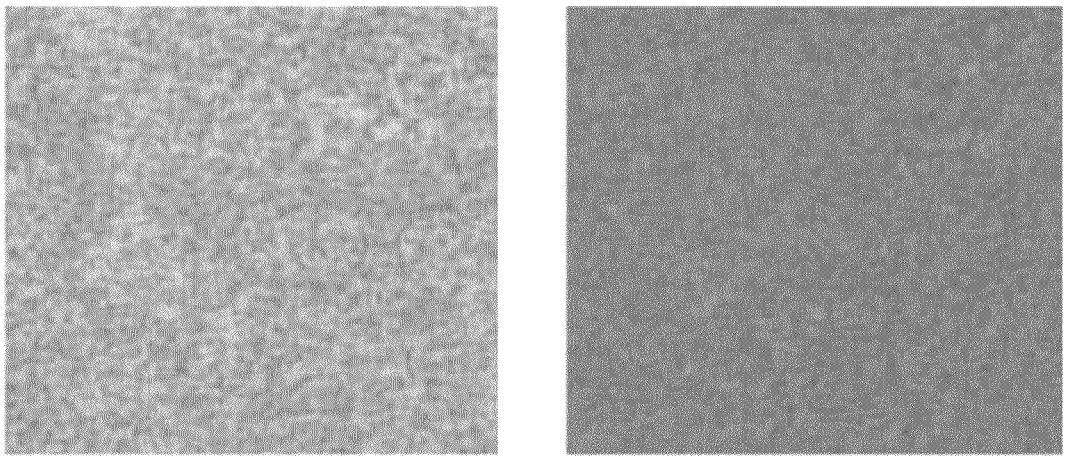

FIG. 3 is a 25-fold enlargement for comparison of the printing effects in embodiment 4.

The left picture shows the printing effect without printing auxiliary agent, the right picture shows the printing effect with printing auxiliary agent.

DETAILED DESCRIPTION

The present invention is further detailed below with reference to the embodiments. It should be understood that theses embodiments are not used to limit the protection scope of the present invention

Embodiment 1

Printing Auxiliary Agent Preparation

Prepare printing auxiliary agent according to the following composition by weight percent.

Method of preparation: have all ingredients uniformly mixed according to the proportion.

| | 1 | 2 | 3 | 4 | 5 | 6 | 7 | 8 | 9 | 10 | 11 | 12 |
|---|---|---|---|---|---|---|---|---|---|---|---|---|
| Water (%) | 40 | 30 | 30 | 100 | | 35 | | 20 | 30 | | | |
| Methanol (%) | 10 | 25 | 30 | | | | 25 | 30 | | | | |
| Ethanol (%) | 10 | 35 | 30 | | 100 | | 20 | 20 | | | | |
| Propanol (%) | | | 10 | | | 30 | | | | | | |
| Isopropanol (%) | | | | | | | | | 50 | | | |
| Ethanediol (%) | 30 | | | | | 30 | | | | | | |
| Propanediol (%) | | 10 | | | | 5 | | | | | | |
| Dipropylene Glycol (%) | 10 | | | | | | | | | | | |
| Dipropylene Glycol Monomethyl Ether (%) | | | | | | | 5 | | | | | |
| Methylbenzene | | | | | | | | | | 30 | | |
| Butanone | | | | | | | | | | 20 | 50 | |
| Cyclohexanone | | | | | | | | | | | | 25 |
| Ethyl Acetate | | | | | | | | | | 50 | 50 | |
| Butyl Acetate | | | | | | | | | | | | 64 |

-continued

| | 1 | 2 | 3 | 4 | 5 | 6 | 7 | 8 | 9 | 10 | 11 | 12 |
|---|---|---|---|---|---|---|---|---|---|---|---|---|
| Resin (%) | | | | | | | 48 | 28 | 18 | | | |
| Oleoresin (%) | | | | | | | | | | | | 11 |
| Antifoaming Agent (%) | | | | | | | 0.5 | 0.5 | 0.5 | | | |
| Rheological Agent (%) | | | | | | | 0.5 | 0.5 | 0.5 | | | |
| Cosolvent (%) | | | | | | | 0.5 | 0.5 | 0.5 | | | |
| Active Agent (%) | | | | | | | 0.5 | 0.5 | 0.5 | | | |

Embodiment 2

Print by a gravure printing press with a substrate of kraft paper, a printing ink of WA-20, and a printing speed of 60 m/min. The printing process adopted is as follow:

1. Uncoiling.
2. Coating and printing the printing auxiliary agent:
3. Take use of the original first printing station of the printing press to print the printing auxiliary agent of composition 1 in embodiment 1 on the substrate at an amount of 5.3 g/m$^2$, and then no heated drying is arranged before turning to step 3.
4. First color (or background color) printing:

Transfer the printing ink from the color disc to the substrate by printing plate.

Figure 1:
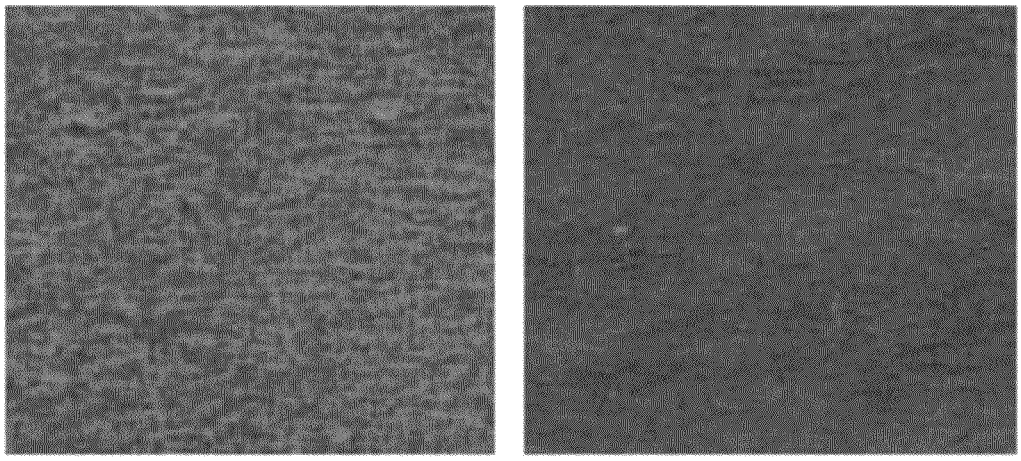
FIG. 1 is a 25-fold enlargement for comparison of the printing effects in embodiment 2.

5. Performing subsequent process according to conventional process
6. Printing process for comparison: all steps except step 2 are the same as that of the printing process mentioned above.
7. The printing results are as shown in FIG. 1. The coloring rate for the printed material that is not applied with the printing auxiliary agent is only 42% by taking the coloring power for the printed material that is coated with the printing auxiliary agent as 100% (please refer to the picture for comparison, wherein the tinting strength test is conducted by X-Rite SP-62 spectrophotometer). As it turns out, the use of printing auxiliary agent can significantly improve the problems of surface white points and missing printing for substrates with rough surface after printing.

Embodiment 3

Print by a gravure printing press with a substrate of art paper, a water-based printing ink of mat WA plus 2% blue, and a printing speed of 80 m/min. The printing process and that for comparison are the same as that of embodiment 2 except for the use of the printing auxiliary agent of composition 3 in embodiment 1 at an amount of 2.5 g/m$^2$.

The printing results are as shown in FIG. 2. The coloring rate for the printed material that is not applied with the printing auxiliary agent is only 76% by taking the coloring rate for the printed material that is coated with the printing auxiliary agent as 100% (please refer to the picture for comparison, wherein the tinting strength is tested by X-Rite SP-62 spectrophotometer). As it turns out, the use of printing auxiliary agent can improve the problems of surface white points and missing printing for substrates with rough surface after printing.

Embodiment 4

Print by a gravure printing press with a substrate of newsprint paper, a water-based printing ink of WA-20 plus 2% blue, and a printing speed of 50 m/min. The printing process and that for comparison are the same as that of embodiment 2 except for the use of the printing auxiliary agent of composition 2 in embodiment 1 at an amount of 3.1 g/m$^2$.

The printing results are as shown in FIG. 3. As shown in FIG. 3, for the printed material that has been applied by the printing auxiliary agent, the dye uptake is 100%. However, for those has not been applied by the printing auxiliary agent, the dye uptake is 80%. (please refer to the picture for comparison, wherein the relative tinting strength is tested by X-Rite SP-62 spectrophotometer). As it turns out, the use of printing auxiliary agent can significantly improve the problems of surface white points and missing printing for substrates with rough surface after printing.

Embodiment 5

Gravure Printing on Book Paper

A four-color gravure printing press is adopted to perform single-color (of blue) printing on book paper of 90 g/m$^2$. A 180-mesh gravure printing roller is mounted at the first machine position of the same gravure printing press before printing so as to perform printing progress in a regular printing mode by using the printing auxiliary agent (of 100% water) at an amount of 6.2 g/m$^2$, and no heated drying process is arranged before the next step of full printing of blue with a 180-mesh gravure anilox roller by the second printing plate. The printed material is fully and uniformly finished in blue without obvious white leak upon visual inspection, while obvious white leak can be found upon visual inspection for the printed material that is not applied with the printing auxiliary agent by the first printing plate. The coloring rate for the printed material that is not applied with the printing auxiliary agent is only 57% by taking the coloring rate for the printed material that is coated with the printing auxiliary agent as 100% (wherein the relative tinting strength is tested by X-Rite SP-62 spectrophotometer).

Embodiment 6

Gravure Printing on Nonwoven Fabrics

A four-color gravure printing press is adopted to perform single-color (of brown) printing on nonwoven fabrics of 147 g/m$^2$. A 100-mesh gravure printing roller is mounted at the first machine position of the same gravure printing press before printing so as to print the printing auxiliary agent (of ethanol) in an regular printing mode at an amount of 12 g/m$^2$, and no heated drying process is arranged before the next step of full printing of brown with a 150-mesh gravure anilox roller by the second printing plate. The printed material is fully and uniformly finished in blue without obvious white leak upon visual inspection, while obvious white leak can be found upon visual inspection for the printed material that is not applied with printing auxiliary agent by the first printing plate. The coloring rate for the printed material that is not applied with the printing auxiliary agent is only 39% by taking the coloring rate for the printed material that is coated with the printing auxiliary agent as 100% (wherein the relative coloring power is tested by X-Rite SP-62 spectrophotometer).

The same method is used, with ethanol being respectively replaced by methanol, isopropanol, ethanediol, propanediol, diethylene glycol, dipropylene glycol, dipropylene glycol monomethyl ether, dipropylene glycol monoethyl ether, dipropylene glycol monopropyl ether, dipropylene glycol monobutyl ether, diethylene glycol monomethyl ether, diethylene glycol monoethyl ether, diethylene glycol monopropyl ether, or diethylene glycol monobutyl ether to be used as the printing auxiliary agent, the printing results turn out to be that the coloring rates for the printed material that is not applied with the printing auxiliary agent is only ranging from 35% to 65% by taking the coloring rate for the printed material that is coated with the printing auxiliary agent as 100%

Embodiment 7

Screen Printing on Nonwoven Fabrics

A screen printing press is adopted to print dark blue on nonwoven fabrics with a 300-mesh screen. A spraying device is used to spray the printing auxiliary agent (of composition 6 in embodiment 1) on the surface of nonwoven fabrics at an amount of 12 g/m$^2$ before printing to wet the substrate surface, and no heated drying process is arranged before the next regular full printing of dark blue and the immediate drying by hot wind. The printed material is finished in bright color and no white leak is found upon visual inspection, while obvious white leak can be found upon visual inspection for the printed material that is not applied with the printing auxiliary agent. The coloring rate for the printed material that is not applied with the printing auxiliary agent is only 54% by taking the coloring rate for the printed material that is coated with the printing auxiliary agent as 100% (wherein the relative tinting strength is tested by X-Rite SP-62 spectrophotometer).

The same method is used, with composition 6 being respectively replaced by water, methanol, ethanol, isopropanol, ethanediol, propanediol, diethylene glycol, dipropylene glycol, dipropylene glycol monomethyl ether, dipropylene glycol monoethyl ether, dipropylene glycol monopropyl ether, dipropylene glycol monobutyl ether, diethylene glycol monomethyl ether, diethylene glycol monoethyl ether, diethylene glycol monopropyl ether, or diethylene glycol monobutyl ether to be used as the printing auxiliary agent, the printing results turn out to be that the coloring rate for the printed material that is not applied with the printing auxiliary agent is only ranging from 41% to 67% by taking the coloring rate for the printed material that is coated with the printing auxiliary agent as 100%

Embodiment 8

Flexographic Printing on Kraft Paper

A three-color sheet-fed flexographic printing press is adopted to print dark block on kraft paper with a 200-mesh anilox roller. Before printing, take use of the position of the first printing plate of the same flexographic printing press to transfer the printing auxiliary agent (of composition 4 in embodiment 1) on the portion to be printed in a regular flexographic printing mode at an amount of 6.7 g/m$^2$, and no heated drying process is arranged before the next step of overprinting black block at the second printing plate. The finished color block is clear and rich without any white leak. The coloring rate for the printed material that is not applied with the printing auxiliary agent is only 51% by taking the coloring rate for the printed material that is coated with the printing auxiliary agent as 100% (wherein the relative tinting strength is tested by X-Rite SP-62 spectrophotometer).

When the same method is used, except that the printing auxiliary agent is respectively replaced by methanol, ethanol, isopropanol, ethanediol, propanediol, diethylene glycol, dipropylene glycol, dipropylene glycol monomethyl ether, dipropylene glycol monoethyl ether, dipropylene glycol monopropyl ether, dipropylene glycol monobutyl ether, diethylene glycol monomethyl ether, diethylene glycol monoethyl ether, diethylene glycol monopropyl ether, or diethylene glycol monobutyl ether, the printing results turn out to be that the coloring rate for the printed material that is not applied with the printing auxiliary agent is only 43%-69% by taking the coloring rate for the printed material that is coated with the printing auxiliary agent as 100%.

Embodiment 9

Rotary Screen Printing on Nonwoven Fabrics

A six-color gravure rotary screen combination printing press is adopted to print dark red on nonwoven fabrics with a 150-mesh rotary screen. An 80-mesh gravure printing roller is mounted at the first machine position of the same rotary screen combination printing press before printing so as to coat the printing auxiliary agent (of composition 6 in embodiment 1) at an amount of 30 g/m$^2$ by lifting the blade, and no heated drying process is arranged before the next step of full printing red by a 150-mesh rotary screen at the second printing station and the immediate drying by hot wind. The printed material is fully and uniformly finished in red without obvious white leak upon visual inspection, while obvious white leak can be found upon visual inspection for the printed material that is not applied with the printing auxiliary agent. The coloring rate for the printed material that is not applied with the printing auxiliary agent is only 63% by taking the coloring rate for the printed material that is coated with the printing auxiliary agent as 100% (wherein the relative tinting strength is tested by X-Rite SP-62 spectrophotometer).

When the same method is used, except that the printing auxiliary agent is respectively replaced by water, methanol, ethanol, isopropanol, ethanediol, propanediol, diethylene glycol, dipropylene glycol, dipropylene glycol monomethyl ether, dipropylene glycol monoethyl ether, dipropylene glycol monopropyl ether, dipropylene glycol monobutyl ether, diethylene glycol monomethyl ether, diethylene glycol monoethyl ether, diethylene glycol monopropyl ether, or diethylene glycol monobutyl ether, the printing results turn out to be that the coloring rate for the printed material that is not applied with the printing auxiliary agent is only 52%-74% by taking the coloring rate for the printed material that is coated with the printing auxiliary agent as 100%.

Embodiment 10

The method used is the same as that of embodiment 9, except that the substrate is replaced by 120-thread count cotton. As it turns out, the coloring rate for the printed material that is not applied with the printing auxiliary agent is only 82% by taking the coloring rate for the printed material that is coated with the printing auxiliary agent as 100%.

Embodiment 11

The method used is the same as that of embodiment 3, except that the substrate is replaced by uneven foamed PVC coating paper. As it turns out, the coloring rate for the printed material that is not applied with the printing auxiliary agent is only 65% by taking the coloring rate for the printed material that is coated with the printing auxiliary agent as 100%.

Embodiment 12

The method used is the same as that of embodiment 7, except that the substrate is replaced by floor tile. As it turns out, the coloring rate for the printed material that is not applied with the printing auxiliary agent is only 78% by taking the coloring rate for the printed material that is coated with the printing auxiliary agent as 100%.

Embodiment 13

The method used is the same as that of embodiment 3, except that the printing auxiliary agent is replaced by composition 7 in embodiment 1. As it turns out, the coloring rate for the printed material that is not applied with the printing auxiliary agent is only 93% by taking the coloring rate for the printed material that is coated with the printing auxiliary agent as 100%.

Embodiment 14

The method used is the same as that of embodiment 3, except that the printing auxiliary agent is replaced by composition 8 in embodiment 1. As it turns out, the coloring rate for the printed material that is not applied with the printing auxiliary agent is only 86% by taking the coloring rate for the printed material that is coated with the printing auxiliary agent as 100%.

Embodiment 15

The method used is the same as that of embodiment 3, except that the printing auxiliary agent is replaced by composition 9 in embodiment 1. As it turns out, the coloring rate for the printed material that is not applied with the printing auxiliary agent is only 79% by taking the coloring rate for the printed material that is coated with the printing auxiliary agent as 100%.

Embodiment 16

The method used is the same as that of embodiment 4, except that the printing auxiliary agent is replaced by composition 10 in embodiment 1 (at an amount of 3.5 g/m$^2$). As it turns out, the coloring rate for the printed material that is not applied with the printing auxiliary agent is only 76% by taking the coloring rate for the printed material that is coated with the printing auxiliary agent as 100%.

When the same method is used, except that the printing auxiliary agent is replaced by benzene, methylbenzene, dimethyl benzene, propanone, butanone, cyclohexanone, ethyl acetate, propyl acetate, or butyl acetate, the printing results turn out to be that the coloring rate for the printed material that is not applied with the printing auxiliary agent is only 73%-88% by taking the coloring rate for the printed material that is coated with the printing auxiliary agent as 100%.

Embodiment 17

The method used is the same as that of embodiment 4, except that the printing auxiliary agent is replaced by composition 11 in embodiment 1 (at an amount of 3.3 g/m$^2$). As it turns out, the coloring rate for the printed material that is not applied with the printing auxiliary agent is only 79% by taking the coloring rate for the printed material that is coated with the printing auxiliary agent as 100%.

Embodiment 18

The method used is the same as that of embodiment 4, except that the printing auxiliary agent is replaced by composition 12 in embodiment 1 (at an amount of 4 g/m$^2$). As it turns out, the coloring rate for the printed material that is not applied with the printing auxiliary agent is only 83% by taking the coloring rate for the printed material that is coated with the printing auxiliary agent as 100%.

Given the disclosure of the present invention, it is apparent to those skilled in the art that further modifications based on the printing process of the present invention can be made to the printing auxiliary agent according to the printing speed, heating conditions, and gas supply and exhaustion conditions so as to obtain the optimal effect. These modifications are also within the protection scope of the present invention.

What is claimed is:

1. A printing process, comprising steps of plate mounting, inking, substrate transport and imprinting, characterized in that before print impression points of any selected printing station, a printing auxiliary agent is applied alone on a substrate to be imprinted, wherein the printing auxiliary agent is:

an organic compound that is liquid under normal conditions, a homogeneous mixture of various organic compounds that is liquid under normal conditions, or a homogeneous mixture of water and single or various organic compounds that is liquid under normal conditions.

2. The printing process according to claim 1, characterized in that the printing auxiliary agent is applied alone on the substrate to be imprinted according to anyone of the following situations:

a printing process involving only one printing station, wherein before the substrate reaching print impression points of the printing station, the printing auxiliary agent is applied on a part or whole of the substrate to be imprinted; or a printing process involving multiple printing stations, wherein one or more printing stations are selected, and, as for any selected printing station, before the substrate that is not imprinted at said printing station reaches print impression points of said printing station, the printing auxiliary agent is applied on a part or whole of the substrate that is not imprinted at said printing station.

3. The printing process according to claim 2, characterized in that a process of independently applying the printing auxiliary agent on a substrate to be imprinted is arranged before the print impression points of the printing station where missing printing or missing coating is most likely to occur.

4. The printing process according to claim 3, characterized in that the process of independently applying the printing auxiliary agent on the substrate to be imprinted is coating.

5. The printing process according to claim 1, characterized in that after being independently applied with the printing auxiliary agent, a retention amount of said printing auxiliary agent on the substrate is 0.5-105 g/m2.

6. The printing process according to claim 5, characterized in that as for nonwoven substrate, the retention amount of said printing auxiliary agent is 1-96 g/m2 on the substrate; as for fabric substrate, the retention amount of said printing auxiliary agent is 5-105 g/m2 on the substrate; as for paper substrate, the retention amount of said printing auxiliary agent is 1-20 g/m2 on the substrate; as for plastic substrate, the retention amount of said printing auxiliary agent is 0.5-15 g/m2 on the substrate; as for rubber substrate, the retention amount of said printing auxiliary agent is 0.5-20 g/m2 on the substrate; as for ceramic substrate, the retention amount of said printing auxiliary agent is 5-50 g/m2 on the substrate.

7. The printing process according to claim 1, characterized in that said substrate is nonwoven substrate, fabric substrate, paper substrate, plastic substrate, rubber substrate, or ceramic substrate.

8. The printing process according to claim 1, characterized in that said substrate is kraft paper, newsprint paper, book paper, glazed paper, art paper, packing paper, poster paper, deckle-edged paper, banknote paper, fiber fabrics, nonwoven fabrics, building board, decorating paper, floor tile or wall tile.

9. The printing process according to claim 1, characterized in that said organic compounds that are liquid under normal conditions are one or more selected from aromatic hydrocarbon, aliphatic hydrocarbon, alicyclic hydrocarbon, halide, alcohol, ether, ester, ketone, phenol and diol derivative that are liquid under normal conditions.

10. The printing process according to claim 1, characterized in that said organic compounds that are liquid under normal conditions are one or more selected from methanol, ethanol, propanol, isopropanol, ethanediol, propanediol, diethylene glycol, dipropylene glycol, dipropylene glycol monomethyl ether, dipropylene glycol monoethyl ether, dipropylene glycol monopropyl ether, dipropylene glycol monobutyl ether, diethylene glycol monomethyl ether, diethylene glycol monoethyl ether, diethylene glycol monopropyl ether, diethylene glycol monobutyl ether, benzene, methylbenzene, dimethyl benzene, propanone, butanone, cyclohexanone, ethyl acetate, propyl acetate and butyl acetate.

11. The printing process according to claim 1, characterized in that said printing auxiliary agent does not comprise resin for printing ink use.

* * * * *